US006110631A

United States Patent [19]

Arai et al.

[11] Patent Number: 6,110,631

[45] Date of Patent: Aug. 29, 2000

[54] PHOTOCONDUCTOR FOR ELECTROPHOTOGRAPHY AND METHOD OF MANUFACTURING AND USING A PHOTOCONDUCTOR

[75] Inventors: Akio Arai; Makoto Fujii; Kazuya Adachi, all of Nagano, Japan

[73] Assignee: Fuji Electric Co., Ltd., Kawasaki, Japan

[21] Appl. No.: 09/078,673

[22] Filed: May 14, 1998

[30] Foreign Application Priority Data

May 14, 1997 [JP] Japan ..... 9-123731

[51] Int. Cl.[7] ..... G03G 5/082; G03G 13/22

[52] U.S. Cl. ..... 430/95; 430/86; 430/126; 399/159

[58] Field of Search ..... 430/86, 95

[56] References Cited

U.S. PATENT DOCUMENTS

| | | | |
|---|---|---|---|
| 3,312,548 | 4/1967 | Straughan | 430/95 |
| 3,655,377 | 4/1972 | Sechak | 430/95 |
| 4,822,712 | 4/1989 | Foley et al. | 430/128 |
| 4,868,077 | 9/1989 | Narita | 430/95 |
| 5,021,310 | 6/1991 | Kitagawa | 430/85 |

*Primary Examiner*—Roland Martin
*Attorney, Agent, or Firm*—Baker & Botts, L.L.P.

[57] ABSTRACT

There is disclosed a photoconductor for use in an electrophotographic apparatus. The photoconductor includes a conductive substrate and a photoconductive layer formed on the conductive substrate. The photoconductive layer includes an $As_2Se_3$ alloy containing 36% to 40% by weight of As and doped with 1,000 to 20,000 parts per million of iodine. A method of manufacturing a photoconductor is also disclosed, which includes forming a photoconductive layer by vapor deposition on a conductive substrate and thermally treating the photoconductive layer at a temperature between 100 and 200 degrees Celsius for a period between 30 and 80 minutes. Advantageously, the photoconductor of the present invention is able to provide high quality images at high printing speeds.

4 Claims, 1 Drawing Sheet

PHOTOCONDUCTOR FOR ELECTROPHOTOGRAPHY AND METHOD OF MANUFACTURING AND USING A PHOTOCONDUCTOR

BACKGROUND OF THE INVENTION

The present invention relates to a photoconductor for electrophotography adapted for use in electrophotographic apparatuses operating at high speeds and at high resolutions, such as high-speed and high-resolution printers, copying machines and facsimiles. The present invention also relates to a method of manufacturing and using such a photoconductor.

To date, tremendous efforts have been focused on improvements in the printing speed, image quality, and resolution of electrophotographic apparatuses, such as copying machines, printers and facsimiles. For conventional electrophotographic apparatuses with printing speeds between 40 and 100 pages per minute and with resolutions of 240 dpi or less, photoconductors that use $As_2Se_3$ as the photoconductive material have been widely adopted by virtue of their excellent resistance against wear after repeated printing cycles. Typically, the thickness of the photoconductive layer is adjusted to be from 60 to 80 $\mu$m, since this layer thickness has been found to reduce the occurrence of image defects when the photoconductor is charged during image development using an electric potential of around 1,000 V.

FIG. 1 is a schematic diagram illustrating a typical imaging process in an electrophotographic apparatus. As shown in FIG. 1, a photoconductor 10 is charged in an charging section 1 in the dark. In an exposure section 2, the photoconductor 10 is exposed to light in a pattern corresponding to the image to be produced. The exposure to light causes a latent electrostatic image to be formed on the photoconductor surface. In a development section 3, developing powder is deposited on the latent electrostatic image, forming a "developed" image. The "developed" image is then transferred onto a carrier paper 6 in a transfer section 4, and the transferred image is fixed onto the carrier paper 6 in a fixing section 5.

FIG. 2 is a cross-sectional schematic diagram showing a photoconductor being charged and then exposed to light. As shown in FIG. 2, a photoconductor 10 includes a photoconductive layer 20 formed on a conductive substrate 30. The photoconductive layer 20 is charged in a charging section 1 under a high voltage (HV). The charging section 1 produces positive charges 12 on the surface of the photoconductive layer 20. When the photoconductor is exposed to light, however, positive and negative charge carriers 14 and 16, respectively, are generated within the photoconductor. Because of the presence of an electric field in the photoconductive layer 20, the positive charge carriers 14 migrate toward the conductive substrate 30, and the negative charge carriers 16 migrate toward the surface of the photoconductive layer 20. When the negative charge carriers 16 reach the surface of the photoconductive layer 20, they neutralize the positive charges 12 thereon, thereby reducing the electric potential of the photoconductor surface. The period of time between when the photoconductor is first exposed to light and when the potential of the photoconductive layer surface drops is determined by the migration period of the negative charge carriers. This period measures the optical response of the photoconductor and hereinafter will be referred to as the "potential drop period."

The potential drop period has consequences for the maximum speed at which an electrophotographic apparatus is able to operate. As the speed of forming the latent electrostatic image is increased—that is, as the rotating speed of the photoconductor is increased—the quantity of light radiated onto the photoconductor surface is reduced. Therefore, to achieve the same reduction in electric potential, the photoconductor is required to exhibit higher photo-sensitivity. Since it takes a certain period of time for the potential of the photoconductor surface to reach its lower level after the photoconductor surface is exposed to light, if the photoconductor does not have increased photosensitivity, when the interval between the light exposure and development steps is shortened (which is the case when the speed of operation of the electrophotographic apparatus is increased), the development step starts before the electric potential of the photoconductor is sufficiently reduced. This unwanted early start of the development step causes imaging defects to occur, such as undesirable density distributions in the developed image. In short, as the speed of operation of an electrophotographic apparatus increases, the photoconductor used therein is required to exhibit an improved optical response to maintain a high image quality.

Although the effect of the potential drop period may be compensated for by increasing the outer diameter of a photoconductor, the outer diameter has an upper limit determined by the outer dimensions of the electrophotographic apparatus in which the photoconductor is used.

Another approach for meeting the requirements of high image quality has been to produce fine-grained developing powder to improve image resolution. However, since the conventional photoconductive layer is thick, some generated carriers migrate laterally. The lateral carrier migration causes bleeding and blurred images. Thus far, however, it has not been possible to form a thin photoconductive layer on a conductive substrate machined by cutting. A conductive substrate machined by cutting typically has a surface roughness Rmax of 0.8 to 12 $\mu$m, which is not desirable for obtaining a thin photoconductive layer. The burrs produced by machine cutting cause voids and black spots in images.

SUMMARY OF THE INVENTION

In view of the foregoing, it is an object of the present invention to provide a photoconductor that may be used with high-speed and high-resolution electrophotographic apparatuses, such as apparatuses having printing speeds of 100 pages per minute or faster and resolutions of 300 dpi or finer.

It is another object of the present invention to provide a photoconductor that produces defect-free images.

It is still another object of the present invention to provide a photoconductor that exhibits a fast optical response.

It is still another object of the present invention to provide a photoconductor that provides high image resolution.

It is a further object of the present invention to provide a method of manufacturing and using such a photoconductor.

According to a preferred embodiment of the present invention, there is provided a photoconductor for use in an electrophotographic apparatus. The photoconductor includes a conductive substrate and a photoconductive layer formed on the conductive substrate. The photoconductive layer includes an $As_2Se_3$ alloy containing 36% to 40% by weight of As and 1,000 to 20,000 parts per million of iodine. In accordance with another preferred embodiment of the present invention, there is provided an electrophotographic apparatus having such a photoconductor.

It has been found that when the As content in the $As_2Se_3$ photoconductive layer is less than 36% by weight, the optical sensitivity of the photoconductor is deteriorated. When the As content in the $As_2Se_3$ photoconductive layer is more than 40% by weight, the charge retention rate of the photoconductor is deteriorated. When the dose amount of iodine is less than 1,000 parts per million, the desirable doping effect of iodine (with regard to improving the optical response of the photoconductor) is not obtained. When the doping amount of iodine is more than 20,000 parts per million, the electrical resistivity of the photoconductor decreases. The decreased resistivity causes increased dark current and a lower charged potential. Thus, in general, the electrostatic characteristics of the photoconductor are deteriorated.

The photoconductive layer preferably has a thickness of 30 to 50 $\mu$m. When the photoconductive layer thickness is thinner than 30 $\mu$m, voids and black spots are produced in the images. A photoconductive layer thicker than 50 $\mu$m causes lateral migration of charge carriers, which causes bleeding and blurred images.

In a most preferred embodiment of the invention, the photoconductive layer has a thickness of 30 to 40 $\mu$m and includes an $As_2Se_3$ alloy containing 36% to 38% by weight of As and 2,000 to 10,000 parts per million of iodine.

Preferably, the electrophotographic apparatus in which the photoconductor is used comprises a charging section for charging the photoconductor that operates under an electric potential of 800 V or lower. Advantageously, under a low electric potential of 800 V or lower, the occurrence of image defects is reduced.

Preferably, the surface roughness Rmax of the conductive substrate is 0.5 $\mu$m or less. More preferably, the surface roughness Rmax of the conductive substrate is 0.3 $\mu$m or less. Advantageously, the occurrence of image defects is reduced when the conductive substrate is polished to such a surface roughness. This finish may be accomplished by using a turning tool for mirror polishing in the cutting work. The material for the conductive substrate may be aluminum, nickel, stainless steel, and other such metals and alloys.

In accordance with a preferred embodiment of the invention, a method of manufacturing a photoconductor for use in an electrophotographic apparatus is also provided. The method includes forming a photoconductive layer by vapor deposition on a conductive substrate and thermally treating the photoconductive layer at a temperature between 100 and 200 degrees Celsius for a period of between 30 and 80 minutes. Advantageously, by thermally treating the photoconductive layer, the sensitivity of the photoconductor is improved.

In accordance with another preferred embodiment of the invention, a method for developing an electrophotographic image is provided, which includes the steps of: charging a photoconductor in the dark under an electrostatic potential of 800 V or lower, the photoconductor comprising a conductive substrate and a photoconductive layer, the photoconductive layer comprising an $As_2Se_3$ alloy containing from 36% to 40% by weight of As and 1,000 to 20,000 parts per million of iodine; exposing the photoconductor to light to form a latent electrostatic image on the photoconductor; developing the latent electrostatic image using developing powder to form a developed image; and transferring the developed image onto a receiving medium to form the electrophotographic image. Preferably, the electrophotographic image is fixed to the receiving medium.

DETAILED DESCRIPTION OF THE INVENTION

Figure 1:
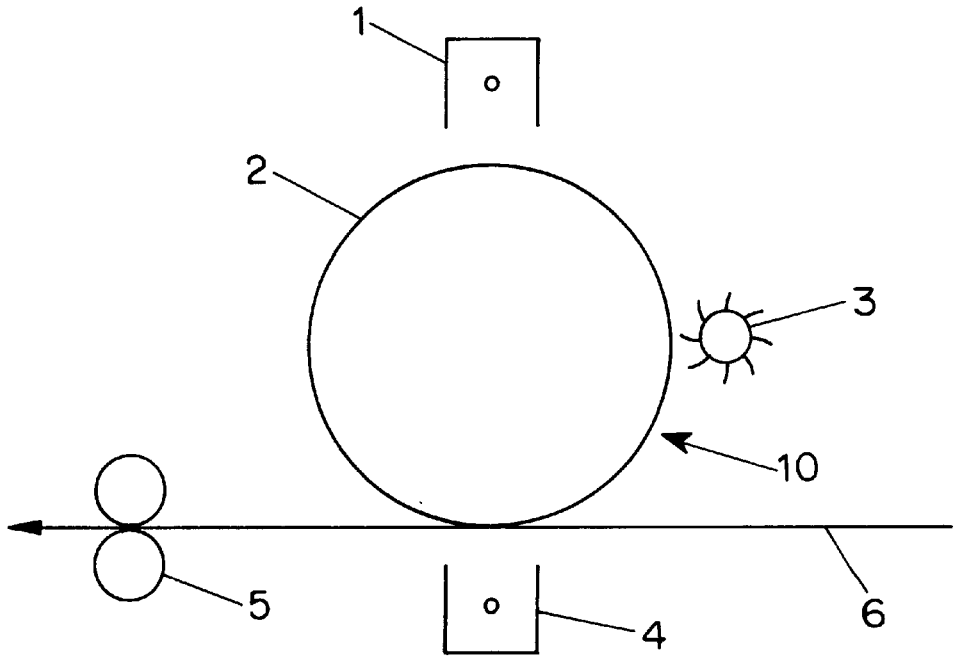
FIG. 1 is a schematic diagram illustrating a typical image development process in an electrophotographic apparatus.
Figure 2:
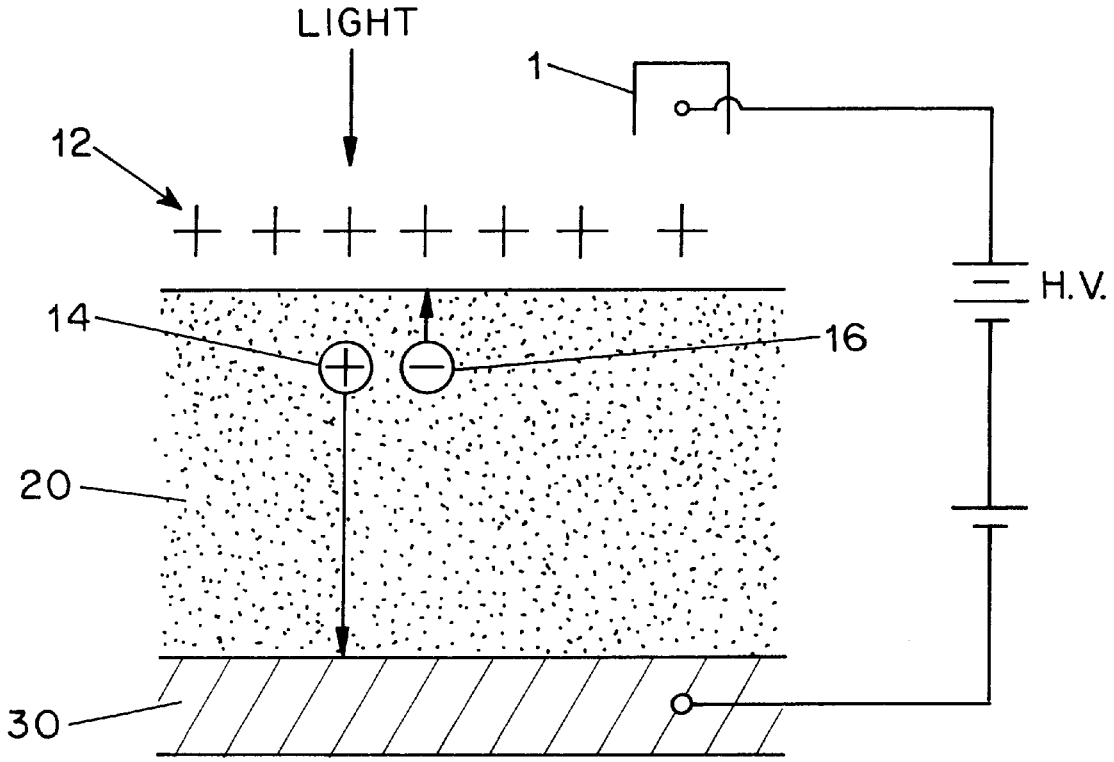
FIG. 2 is a cross-sectional schematic diagram illustrating a photoconductor exposed to light.

The preferred embodiments of the invention will now be explained in detail.

First Group of Embodiments

Three kinds of photoconductive material were prepared by adding 0 parts per million, 2,000 parts per million, and 10,000 parts per million of iodine to an $As_2Se_3$ alloy containing 38% by weight of As. For each photoconductive material, the photoconductive layer thickness was adjusted to be 40 $\mu$m or 70 $\mu$m. Thus, six photoconductors were fabricated. The surface of the substrate was polished to a surface roughness Rmax of 0.8 to 1.0 $\mu$m. Heat treatment after the deposition of the photoconductive layer on the substrate was not conducted.

The six photoconductors, thus fabricated, were evaluated in terms of migration speed of the charge carriers and image qualities obtained by printers with printing speeds of 150 pages per minute (drum circumference speed of 600 mm/s), resolutions of 600 dpi, and electric potentials of 700 V.

Table 1 lists the measured values of carrier mobility and migration speed in the photoconductors. In Table 1, $S^*=\mu \cdot V/L$.

TABLE 1

| Photoconductors | Carrier mobility $\mu$ ($cm^2/V \cdot s$) | Film thickness L ($\mu$m) | Migration speed $S^*$ (cm/s) |
|---|---|---|---|
| $As_2Se_3$ + no iodine added | $1 \times 10^{-5}$ | 40 | 1.75 |
| | | 70 | 1.00 |
| $As_2Se_3$ + 2,000 parts per million of iodine added | $2 \times 10^{-5}$ | 40 | 3.50 |
| | | 70 | 2.00 |
| $As_2Se_3$ + 10,000 parts per million of iodine added | $6 \times 10^{-5}$ | 40 | 10.50 |
| | | 70 | 6.00 |

Table 2 lists the evaluation of image qualities obtained with the photoconductors of the first group of embodiments.

TABLE 2

| Photoconductors | Film thickness L ($\mu$m) | Printing density | Resolution | Blurring (Sharpness) | Total evaluation |
|---|---|---|---|---|---|
| $As_2Se_3$ + no iodine added | 40 | average | average | average | average |
| | 70 | average | poor | poor | poor |
| $As_2Se_3$ + 2,000 parts per million of iodine | 40 | excellent | excellent | excellent | excellent |
| | 70 | average | average | average | average |
| $As_2Se_3$ + 10,000 parts per million of iodine | 40 | excellent | excellent | excellent | excellent |
| | 70 | excellent | excellent | excellent | excellent |

As Table 1 indicates, the charge carriers migrate faster and, therefore, the optical response is improved, with increased dose amounts of iodine and with thinner photoconductive layers. As Table 2 indicates, the resolution and blurring (sharpness) of the images produced by a high-speed printer are also improved with increased dose amounts of iodine and with thinner photoconductive layers.

Second Group of Embodiments

Two kinds of photoconductive material were prepared by adding 0 parts per million and 10,000 parts per million of iodine to an $As_2Se_3$ alloy containing 38% by weight of As. For each photoconductive material, the photoconductive layer thickness was adjusted to be 40 μm. The surface roughness Rmax of the substrates was adjusted to be from 0.8 to 1.0 μm or to be 0.3 μm or thinner. For polishing the substrate to a surface roughness of 0.8 to 1.0 μm a turning tool with a rounded blade tip was used. For polishing the substrate to a surface roughness of 0.3 μm or less, a turning tool with a flat blade of natural diamond was used. Thus, four photoconductors were fabricated. Heat treatment after the deposition of the photoconductive layer on the substrate was not conducted.

The four photoconductors, thus fabricated, were evaluated in terms of migration speed of the charge carriers and image qualities obtained by printers with printing speeds of 150 pages per minute (drum circumference speed of 600 mm/s), resolutions of 600 dpi, and electric potentials of 700 V.

Table 3 lists the measured values of carrier mobility and migration speed in the photoconductors. In Table 3, $S^*=\mu \cdot V/L$.

TABLE 3

| Photoconductors | Carrier mobility $\mu$ ($cm^2/V \cdot s$) | Film thickness L (μm) | Migration speed $S^*$ (cm/s) |
|---|---|---|---|
| $As_2Se_3$ + no iodine added | $1 \times 10^{-5}$ | 40 | 1.75 |
| $As_2Se_3$ + 10,000 parts per million of iodine | $6 \times 10^{-5}$ | 40 | 10.5 |

Table 4 lists the evaluation results of image qualities of the photoconductors of the second group of embodiments.

TABLE 4

| Photoconductors | Surface roughness Rmax (μm) | Resolution | Blurring (Sharpness) | Image Quality (Absence of Defects) | Total evaluation |
|---|---|---|---|---|---|
| $As_2Se_3$ + no iodine added | 0.8 to 1.0 | average | average | average | average |
| | 0.3 | average | average | excellent | average |
| $As_2Se_3$ + 10,000 parts per million of iodine | 0.8 to 1.0 | excellent | excellent | average | average |
| | 0.3 | excellent | excellent | excellent | excellent |

As Table 3 indicates, the charge carriers migrate faster and, therefore, the optical response is improved, with increased dose amounts of iodine. As Table 4 indicates, the resolution and blurring (sharpness) of images produced by a high-speed printer are improved by the iodine doping. The photoconductors with a substrate having a surface roughness Rmax of 0.3 μm or less produced fewer image defects.

Third Group of Embodiments

Two kinds of photoconductive material were prepared by adding 0 parts per million and 10,000 parts per million of iodine to an $As_2Se_3$ alloy containing 38% by weight of As. A photoconductive layer of 40 μm in thickness was deposited on a substrate that had been finished to a surface roughness Rmax of 0.8 to 1.0 μm. Two photoconductors were fabricated for each dose amount of iodine, and one of each pair of photoconductors was treated thermally in a thermostatic oven at 150 degrees Celsius for 60 minutes. The other photoconductor of each pair was not thermally treated.

The four photoconductors, thus fabricated, were evaluated in terms of migration speed of the charge carriers and image qualities, including printing density and resolution, obtained by printers with printing speeds of 200 pages per minute (circumference speed of 800 mm/s), resolutions of 600 dpi, and electric potentials of 700 V.

Table 5 lists the measured values of carrier mobility and migration speed in the photoconductors. In the table, $S^*=\mu \cdot V/L$.

TABLE 5

| Photoconductors | Carrier mobility $\mu$ ($cm^2/V \cdot s$) | Film thickness L (μm) | Migration speed $S^*$ (cm/s) |
|---|---|---|---|
| $As_2Se_3$ + no iodine added | $1 \times 10^{-5}$ | 40 | 1.75 |
| $As_2Se_3$ + 10,000 parts per million of iodine | $6 \times 10^{-5}$ | 40 | 10.5 |

Table 6 lists the evaluation results of image qualities including printing density, resolution and blurring (sharpness). In Table 6, the sensitivity is represented by the light potential under an exposure light intensity of 1 $\mu J/cm^2$. Therefore, a lower potential indicates higher sensitivity.

TABLE 6

| Photoconductors | Film thickness (μm) | Heat Treatment | Sensitivity (Light Potential) (V) | Image Quality (Absence of Defects) | Total evaluation |
|---|---|---|---|---|---|
| $As_2Se_3$ + no iodine added | 40 | None | 115 | poor | poor |
| | | Applied | 105 | average | average |
| $As_2Se_3$ + 10,000 parts per million of iodine | 40 | None | 70 | average | average |
| | | Applied | 55 | excellent | excellent |

As Table 5 indicates, the charge carriers migrate faster and, therefore, the optical response is improved, with increased dose amounts of iodine. As Table 6 indicates, the sensitivity, printing density, resolution and blurring (sharpness) of the images produced by a very high-speed printer are also improved by heat treatment.

As described above, the photoconductor of the present invention advantageously has an improved optical response and is capable of higher resolutions over conventional photoconductors, thereby allowing electrophotographic apparatuses to operate at higher printing speeds and to provide better image quality.

Although the present invention has been described with reference to certain preferred embodiments, various modifications, alterations, and substitutions will be known or obvious to those skilled in the art without departing from the spirit and scope of the invention, as defined by the appended claims.

We claim:

1. A photoconductor for use in an electrophotographic apparatus, wherein said electrophotographic apparatus comprises a charging section for charging said photoconductor, said charging section operating under an electric potential of 800 V or lower, said photoconductor comprising:

a conductive substrate;

a photoconductive layer formed on said conductive substrate, said photoconductive layer comprising an $As_2Se_3$ alloy containing 36% to 40% by weight of As and 1,000 to 20,000 parts per million of iodine, wherein said photoconductive layer has a thickness of 30 $\mu$m to 50 $\mu$m, and wherein the surface roughness Rmax of said conductive substrate is 0.5 $\mu$m or less.

2. An electrophotographic printing apparatus, wherein said electrophotographic printing apparatus comprises a charging section for charging said photoconductor, said charging section operating under an electric potential of 800 V or lower, comprising a photoconductor having a conductive substrate wherein the surface roughness Rmax of said conductive substrate is 0.5 $\mu$m or less, and a photoconductive layer, wherein said photoconductive layer has a thickness of 30 $\mu$m to 50 $\mu$m, said photoconductive layer comprising an $As_2Se_3$ alloy containing from 36% to 40% by weight of As and 1,000 to 20,000 parts per million of iodine.

3. A method for developing an electrophotographic image, comprising:

charging a photoconductor in the dark under an electrostatic potential of 800 V or lower, said photoconductor comprising a conductive substrate and a photoconductive layer, said photoconductive layer comprising an $As_2Se_3$ alloy containing from 36% to 40% by weight of As and 1,000 to 20,000 parts per million of iodine, wherein said photoconductive layer has a thickness of 30 $\mu$m to 50 $\mu$m, and wherein the surface roughness of said conductive substrate is 0.5 $\mu$m or less;

exposing said photoconductor to light to form a latent electrostatic image on said photoconductor;

developing said latent electrostatic image using developing powder to form a developed image; and transferring said developed image onto a receiving medium to form said electrophotographic image.

4. The method of claim 3, further comprising the step of fixing said electrophotographic image onto said receiving medium.

* * * * *